United States Patent [19]

Bullard

[11] Patent Number: 4,732,255

[45] Date of Patent: Mar. 22, 1988

[54] DISPENSING APPARATUS

[76] Inventor: Wade A. Bullard, 20254 Detente Rd., Sturgis, Mich. 49091

[21] Appl. No.: 41,631

[22] Filed: Apr. 23, 1987

Related U.S. Application Data

[63] Continuation of Ser. No. 830,628, Feb. 18, 1986, abandoned.

[51] Int. Cl.[4] ..... G07F 11/24; G07F 5/00

[52] U.S. Cl. ..... 194/248; 29/121.6; 74/578; 194/233; 194/258; 194/259; 221/43; 221/231; 221/232; 271/116; 271/128

[58] Field of Search ..... 221/42, 43, 210, 259, 221/260, 268, 270, 277, 231, 232, 258; 271/116, 128; 194/233, 248, 258; 74/578; 29/121.6

[56] References Cited

U.S. PATENT DOCUMENTS

| | | | |
|---|---|---|---|
| 369,159 | 8/1887 | Burns | 74/578 X |
| 428,720 | 5/1890 | Hanicke et al. | 221/259 X |
| 479,688 | 7/1892 | Weller | 221/259 X |
| 497,944 | 4/1893 | Broome | 74/578 X |
| 499,312 | 6/1893 | Turner | 74/578 X |
| 505,592 | 9/1893 | Coleman | 74/578 X |
| 536,690 | 4/1895 | Loewenbach et al. | 221/259 X |
| 757,484 | 4/1904 | McGirr et al. | 271/116 X |
| 946,347 | 1/1910 | Giroud | 271/128 |
| 960,138 | 5/1910 | Adams et al. | 271/116 |
| 1,486,079 | 3/1924 | Fernandez | 221/43 |
| 1,720,588 | 7/1929 | Cameron . | |
| 1,846,484 | 2/1932 | Gruber . | |
| 1,886,694 | 11/1932 | Kelly | 221/42 X |
| 2,062,643 | 12/1936 | Edmunds | 271/42 |
| 2,180,326 | 11/1939 | Traversy . | |
| 2,702,145 | 2/1955 | Paulas | 221/43 |
| 2,777,330 | 1/1957 | Barclay | 29/721.6 |
| 2,904,214 | 9/1959 | Miller | 221/43 |
| 3,062,406 | 11/1962 | Kent et al. | 221/270 X |
| 3,082,910 | 3/1963 | Skold . | |
| 3,107,770 | 10/1963 | Short | 221/42 X |
| 3,158,248 | 11/1964 | Hawks . | |
| 3,642,271 | 2/1972 | Davis | 271/116 |
| 3,709,405 | 1/1973 | Harris . | |
| 3,712,441 | 1/1973 | Taylor | 194/233 |
| 3,760,923 | 9/1973 | Voegeli | 194/233 |
| 3,871,641 | 8/1975 | Marx et al. . | |
| 3,881,535 | 5/1975 | DuBois et al. | 74/578 X |
| 3,917,113 | 11/1975 | Light . | |
| 3,917,114 | 11/1975 | Grosse | 221/259 X |
| 4,496,074 | 1/1985 | Owens | 221/259 X |
| 4,515,382 | 5/1985 | Boese | 74/578 X |
| 4,530,444 | 7/1985 | Christian | 271/128 X |
| 4,544,294 | 10/1985 | Rünzi | 271/116 X |
| 4,566,581 | 1/1986 | Martin | 194/248 |
| 4,579,215 | 4/1986 | Medley, III | 194/233 |

FOREIGN PATENT DOCUMENTS

| | | | |
|---|---|---|---|
| 1941894 | 3/1971 | Fed. Rep. of Germany | 221/259 |
| 873539 | 7/1942 | France | 221/43 |
| 157653 | 9/1983 | Japan | 271/116 |
| 11177 | of 1898 | United Kingdom | 74/578 |

*Primary Examiner*—L. J. Paperner
*Assistant Examiner*—P. McCoy Smith
*Attorney, Agent, or Firm*—Ian C. McLeod

[57] ABSTRACT

A dispensing apparatus 10 for elongate flat articles such as newspapers is described. The mechanism uses a rachet or pawl mechanism 36 or 36*a* to control a roller 23 or 23*a* rotatably mounted on a shaft 24 or 51 for dispensing the articles with the shaft and roller locked together. The roller has a cylindrical cross-section in continuous contact with the uppermost article to be dispensed by turning a crank handle 53 or by pulling a pull bar 28. The rachet or pawl mechanism and support plate 18 for the articles P are constructed to be rugged and reliable in dispensing the articles. Self lubricating bearings 18*a* are mounted on the plate for movement on multiple posts 12. The rachet mechanism engages indentations 38 on the end 37 of the roll.

10 Claims, 12 Drawing Figures

DISPENSING APPARATUS

CROSS REFERENCE TO RELATED APPLICATION

This application is a continuation of Ser. No. 830,628 filed Feb. 18, 1986, now abandoned.

BACKGROUND OF THE INVENTION (1) Field of the Invention

The present invention relates to a dispensing apparatus for elongate flat articles, especially newspapers, magazines, books and the like. In particular the present invention relates to a dispensing apparatus which uses a rachet or pawl mechanism which engages a roller with notches or indentations provided around at least one end of a horizontally oriented roller on a shaft such that the mechanism locks the shaft and roller together for dispensing of the articles by the roller and then releases the roller to roll on the shaft in a non-dispensing direction.

(2) Prior Art

Numerous dispensing mechanisms has been described by the prior art. They are generally quite complicated, expensive and unreliable and have not found wide use. The most common newspaper dispenser is a box which opens in the front when a coin is inserted in a slot in a coin holder, thus exposing all of the newspapers in the box. The loss of newspapers from such dispensers is very large (about 25%) but so far a reliable single paper dispenser has not been available. Another problem is that the weather renders the dispenser inoperative because of heat or of freezing of lubricants or water and the like in the mechanism.

U.S. Pat. No. 1,720,588 to Cameron describes the use of a dispensing plate carrying the article which is moved out of an opening in the front of the apparatus. A shaft is moved by a handle to dispense the article, such as a newspaper. U.S. Pat. No. 1,846,484 to Gruber shows a dispenser which uses a movable friction roller to dispense a sheet of paper. U.S. Pat. No. 2,180,326 to Traversy describes a device wherein a pick device engages a newspaper on the top of a stack to dispense the newspaper. U.S. Pat. No. 3,082,910 to Skold shows a dispenser which relies on gravity to dispense the newspaper. U.S. Pat. No. 3,158,248 to Hawks shows sideways dispensing of vertically oriented newspapers. U.S. Pat. No. 3,709,405 to Harris describes a complex device which uses pins to engage the newspaper for dispensing. U.S. Pat. No. 3,871,641 shows a single sheet feeding device. U.S. Pat. No. 3,917,113 shows a map dispenser which uses linear movement of a projection to dispense the map. As can be seen from these patents the prior art devices are complex and are not believed to be particularly reliable in dispensing, particularly where the dispenser is exposed to the elements.

OBJECTS

It is therefore an object of the present invention to provide a dispenser apparatus which provides reliable positive dispensing of an article such as a newspaper. Further it is an object of the present invention to provide a dispenser apparatus which operates reliably when exposed to the elements. Further still it is an object of the present invention to provide a dispensing apparatus which is simple and inexpensive to construct. Finally it is an object of the present invention to provide a coin mechanism for regulating the dispensing of the articles. These and other objects will become increasingly apparent by reference to the following description and the drawings.

IN THE DRAWINGS

FIG. 1 is a front view of one embodiment of a dispenser apparatus 10 of the present invention particularly illustrating a roller 23 with rubber rings 25 in contact with a newspaper $P_1$ for dispensing upon movement of the roller.

FIG. 2 is a side view of the dispenser apparatus of FIG. 1 showing the roller 23 as well as legs 27 connected to a pullbar 28 which is pulled horizontally away from the apparatus 10 to move the roller 23 to dispense the newspaper $P_1$.

FIG. 3 is a plan sectional view along line 3—3 of FIG. 2.

FIG. 4 is an enlarged front view of the roller 22 particularly illustrating holders 26 mounting the shaft 24 for the roller 23 and supporting the legs 27 and pullbar 28 so that the roller and shaft can be moved horizontally.

FIG. 5 is a front partial sectional view of the roller 23 along line 5—5 of FIG. 4, particularly illustrating the detailed construction of the rachet or pawl 39 mechanism 36 for the roller 23.

FIG. 6 is side or end sectional view along line 6—6 of FIG. 5 particularly illustrating the rachet 39 and indentations 38 around one end of the roller 23.

FIG. 7 is a front partial cross-sectional view along line 7—7 of FIG. 6, particularly illustrating the rachet 39 and indentations 38.

Figure 11:
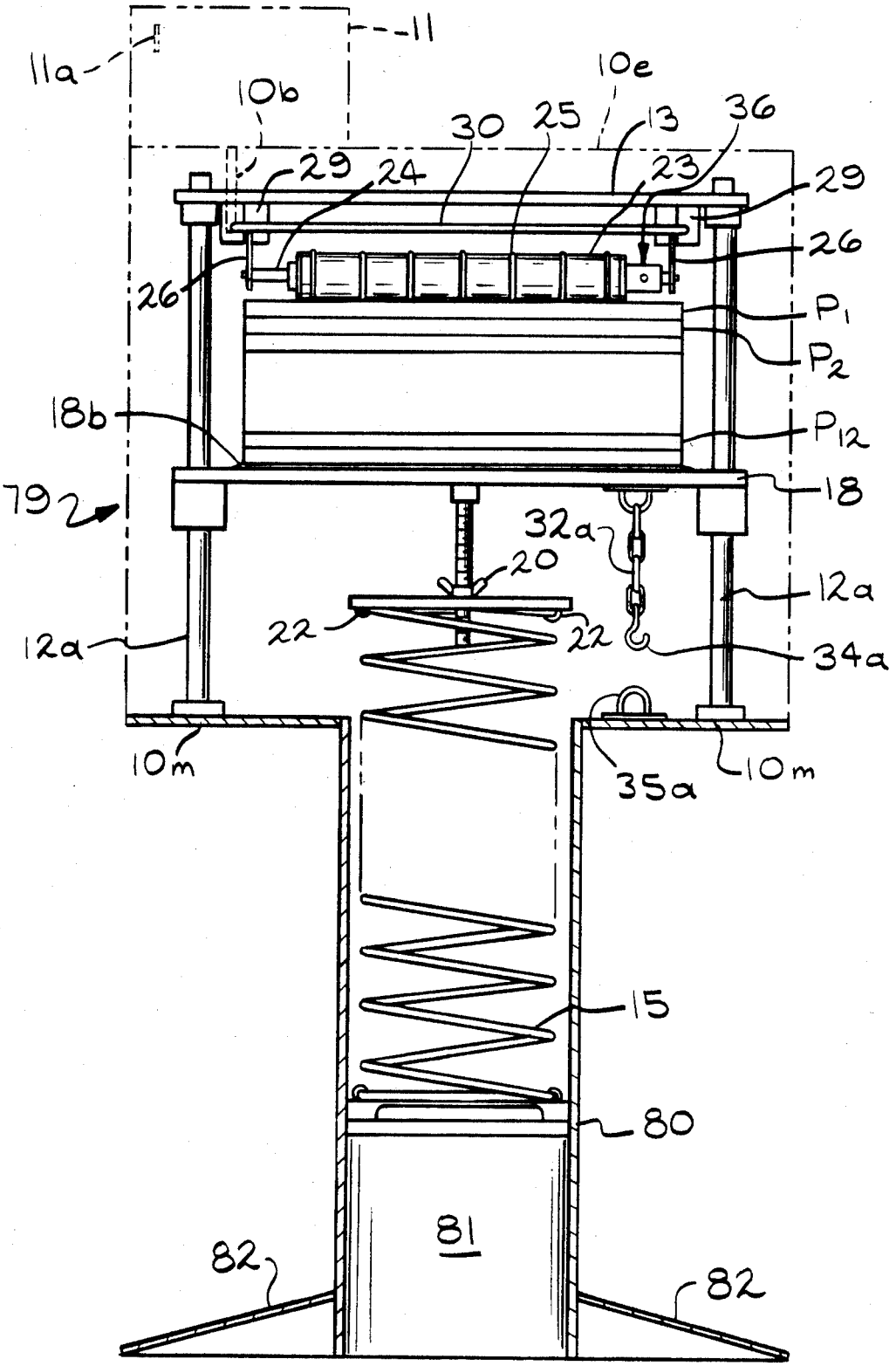

FIG. 11 is a front view in partial section of a modified dispenser apparatus 79 wherein a hollow post 80 supports the coil spring 15.

Figure 12:
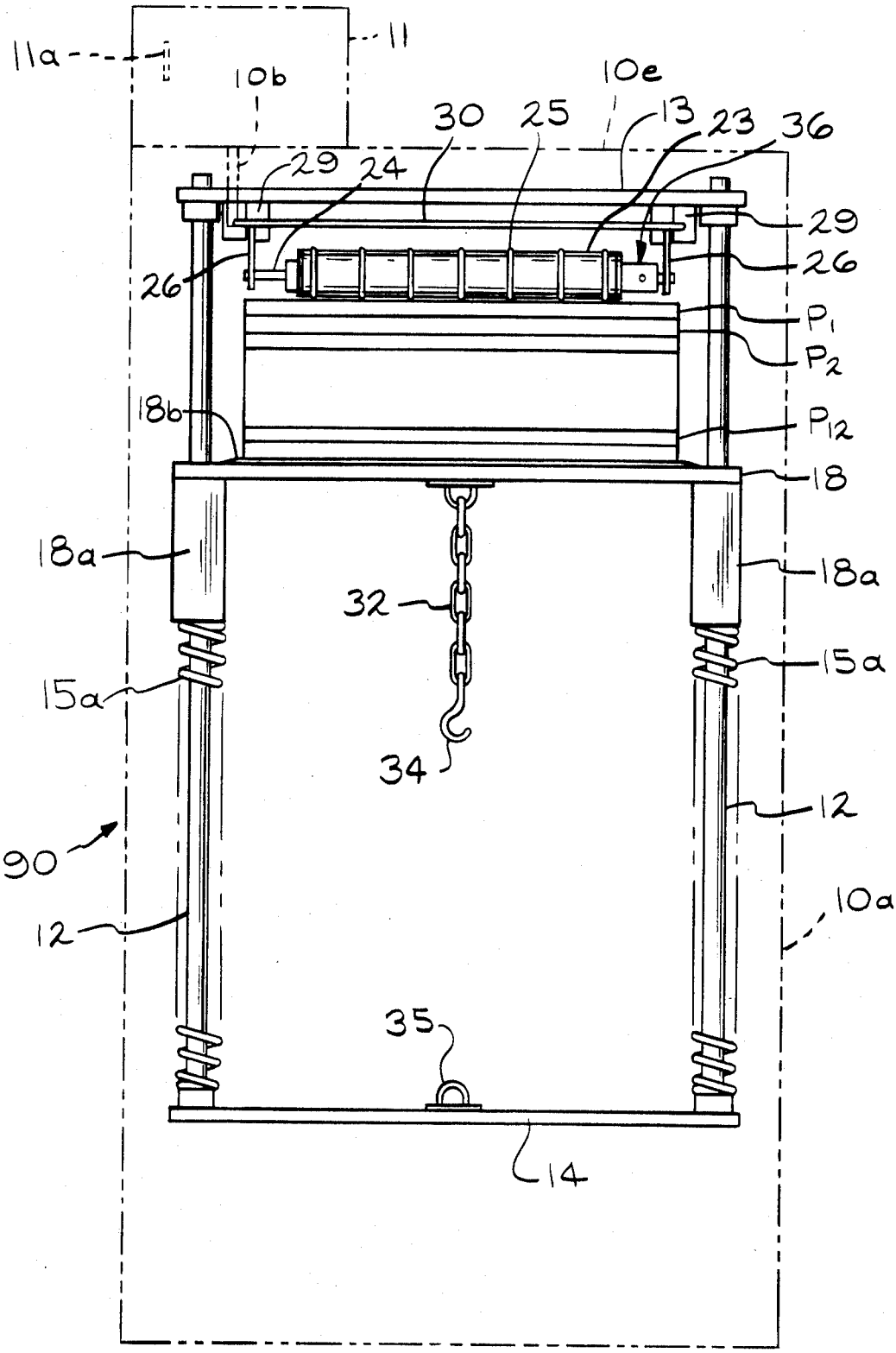

FIG. 12 is a front view of a modified dispenser apparatus 90 illustrating springs **15*a* mounted on vertical posts 12**.

GENERAL DESCRIPTION

The present invention relates to a dispensing apparatus for a pile of identical elongate flat articles having horizontally oriented sides and front and rear edges between the sides which comprises: a housing with spaced apart side walls with an opening on a front wall for dispensing the articles one at a time such that the front edge of the article projects out of the opening for manual removal; support plate means horizontally mounted in the housing below the opening for supporting the pile of articles with the front edges towards the front end of the housing wherein the support plate means is vertically moveable in the housing; resilient means for urging the support plate means vertically so as to align articles with the opening in the housing for dispensing; ejector means including roll means having opposing ends rotationally mounted on a shaft inside the housing above the support plate so that the roll means is in contact with an uppermost article on the pile of articles for dispensing the uppermost article, wherein the shaft is journaled for rotation on a longitudinal axis between the opposed ends of the roller means; rachet means mounted on the shaft on at least one of the ends of the roll means such that the end of the roll means is engaged by the rachet means and such that the roll means rotates on the shaft in only one direction when the roll means is rotated away from the opening and prevents rotation of the roll means on the shaft when the roll is rotated towards the opening; and handle means mounted on the shaft which can move the shaft and roll means together with the rachet means preventing rotation of the roll means on the shaft so as to dispense the article.

The roller means can be driven by various means such as a horizontally movable handle or a rotatable crank. The crank is preferred.

SPECIFIC DESCRIPTION

FIGS. 1 to 7 show one preferred embodiment of the dispenser apparatus 10 for dispensing newspapers $P_1$, $P_2$ to $P_n$. As shown by the dotted lines, the apparatus 10 includes side walls 10*a* and 10*b* and front and rear walls 10*c* and 10*d*, respectively, which prevent entry inside the apparatus 10. The front wall 10*c* is hinged and includes a lock (not shown) so that the newspapers can be inserted in the apparatus 10. A conventional coin holder 11 with a coin slot 11*a* is supported in the top 10*e* of the apparatus 10.

The mechanism for the dispensing apparatus 10 is supported inside the walls 10*a* to 10*e* and includes vertical posts 12 supporting upper and lower frame members 13 and 14. A coil spring 15 is mounted on the lower frame member 14 by lower spring retained 16 and is held in place by U bolts 17. The spring 15 upwardly biases a support plate 18 having downwardly depending bushings 18*a* on each of the posts 12. The bushings 18*a* are slideably mounted on the posts 12. The bushings 18*a* are preferably made of a self-lubricating plastic such as GAR-DUR TM sold by Garland Manufacturing Co., Saco, Maine, U.S.A. The support plate 18 preferably has a raised slippery surface 18*b* such as a Teflon TM surface. A bolt 19 is secured to the center of the support plate 18. The bolt 19 passes through an opening (not shown) in the center of an upper spring retainer plate 20. A wing nut 21 is provided on the bolt 19 which is used to adjust the position of the retainer plate 20 relative to the support plate 18 so that the compression of the spring 15 can be adjusted. The spring 15 is held on retainer plate 20 by U bolts 22.

The newspaper $P_1$, $P_2$, $P_3$ to $P_n$ are horizontally mounted in the support plate 18, preferably such that the fold (not shown) is away from the front wall 10*c* for assured dispensing. The spring 15 and support plate 10 urge the newspapers towards a roller 23 mounted on a shaft 24. The roller 23 has rubber rings 25 around its outer surface which engage the uppermost newspaper $P_1$. The roller 23 is rotatably mounted on the shaft 24. The shaft 24 is horizontally and rotatably supported by a pair of spaced apart holders 26.

The holders 26 are each mounted on horizontal legs 27 which are connected together by pullbar 28 outside the front 10*c* of the apparatus adjacent the opening 10*f*. The legs 27 are slideably mounted through bushings 29 so that the roller 23 can be pulled across the newspaper $P_1$ in order to dispense the newspaper $P_1$ out of the opening 10*f*. The legs 27 are held together inside the front wall 10*c* by brace 30. Return springs 31 are connected to the holders 26 which urge the roller 23 towards the back wall 10*d* of the apparatus. A coin release bar 11*b* engages the brace 30 to prevent movement of the legs 27 and pullbar 28 unless a coin is inserted in the slot 11*a* of the coin holder 11.

One end of a chain 32 is mounted on the support plate 18 by U bolt 33. At the opposite end of the chain 32 is provided a hook 34. The lower frame 14 mounts on eye bolt 35. The hook 34 engages the eye 35 in order to compress the spring 15 for loading of the papers $P_1$ to $P_n$ into the apparatus 10.

The rotation of the roller 23 on shaft 24 is controlled by a rachet or pawl mechanism 36 such that the roller 23 does not rotate on shaft 24 when the holders 26, legs 27 and pullbar 28 are pulled away from the front wall 10*c* of the apparatus 10. The uppermost newspaper $P_1$ is thus dispensed out of opening 10*f*.

Figure 5:
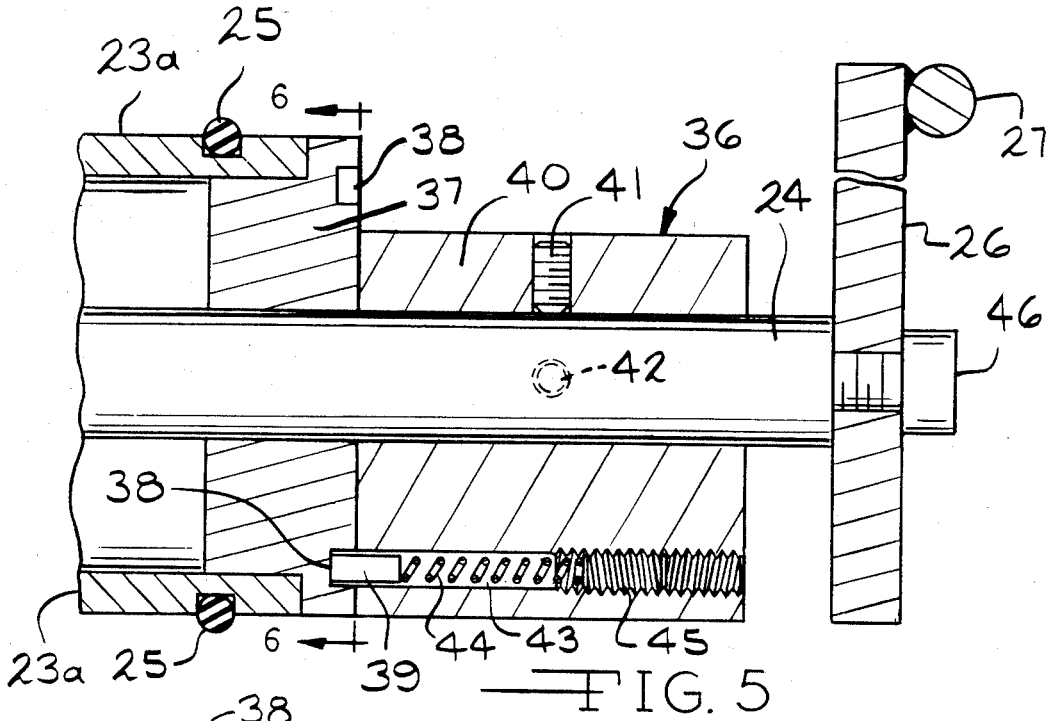
Figure 6:
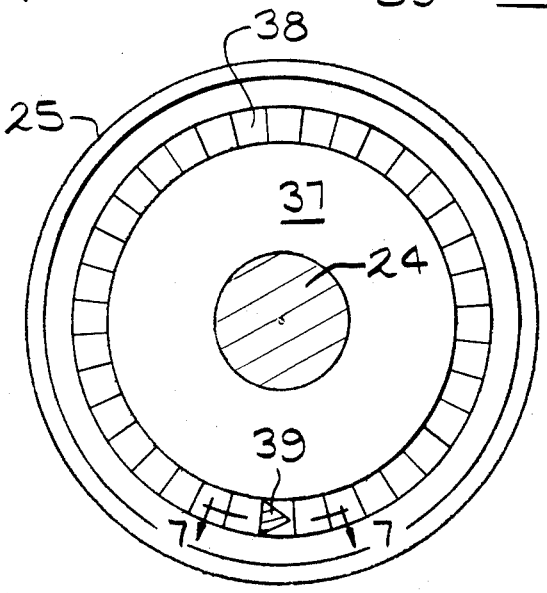
Figure 7:
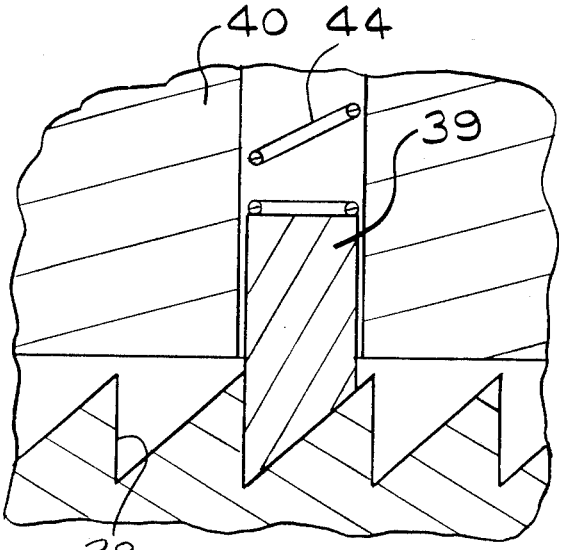

The details of the rachet or pawl mechanism 36 are shown in FIGS. 5 to 7. The roller 23 includes a hollow tube 23*a* with end caps 37 (one shown) journaling the shaft 24 for rotation. One end cap 37 is provided with indentations 38 provided around the shaft 24 which are engaged by a rachet 39. The rachet 39 is supported in a body 40 secured to the shaft 24 by lock nuts 41 and 42. The rachet 39 is provided in a bore 43 in the body 40 and biased by a spring 44 to engage the indentations 38. A lock bolt 45 holds the spring 44 in place in the body 40. Bolts 46 rotatably secure the shaft 24 to the holders 26.

In operation of the apparatus 10, a coin is inserted in opening 11*a* of coin holder 11 to release bar 11*b*. The pullbar 28 is pulled away from the front wall 10*c* of the apparatus so that legs 27 pull the roller 23 and newspaper $P_1$ towards opening 10*f*. The rachet or pawl mechanism 36 prevents the roller 23 from rotating on the shaft 24 and thus the rubber rings 25 engage newspaper $P_1$ and push it horizontally towards the opening 10*f*. The user then pulls the newspaper $P_1$ from the opening. The pullbar 28 is then released and the return spring 31 pulls the roller 23, holders 26, legs 27 and pullbar 28 back to the rest position. The rachet 39 and indentations 38 allow the roller 23 to rotate on the shaft 24 while the roller 23 is returned to the rest position. The spring 15 urges the next adjacent newspaper $P_2$ into engagement with the rings 25 on roller 23 and the apparatus 10 is again ready to dispense newspaper $P_2$ and then the newspapers through $P_n$ in sequence.

Figure 8:
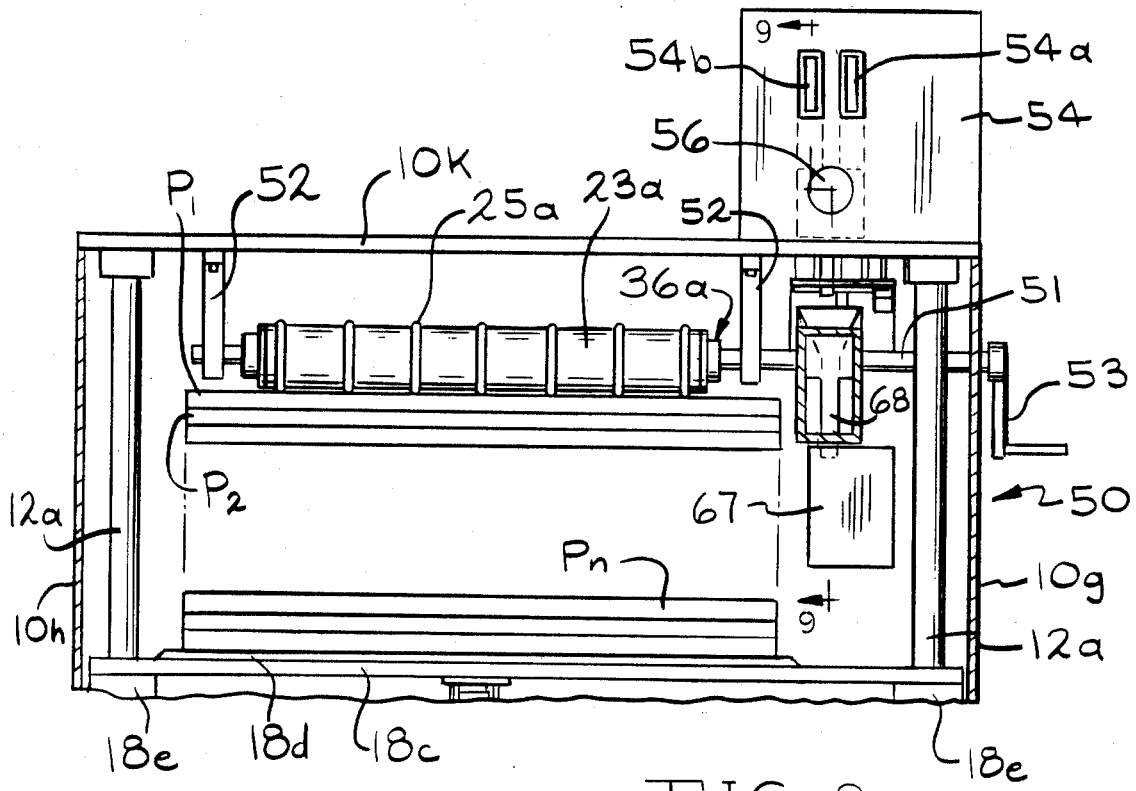
FIG. 8 shows a front view of another preferred embodiment of a dispenser apparatus 50 illustrating a crank handle 53 is used to rotate the roller **23*a*** for dispensing the newspaper $P_1$ and a coin release mechanism.
Figure 9:
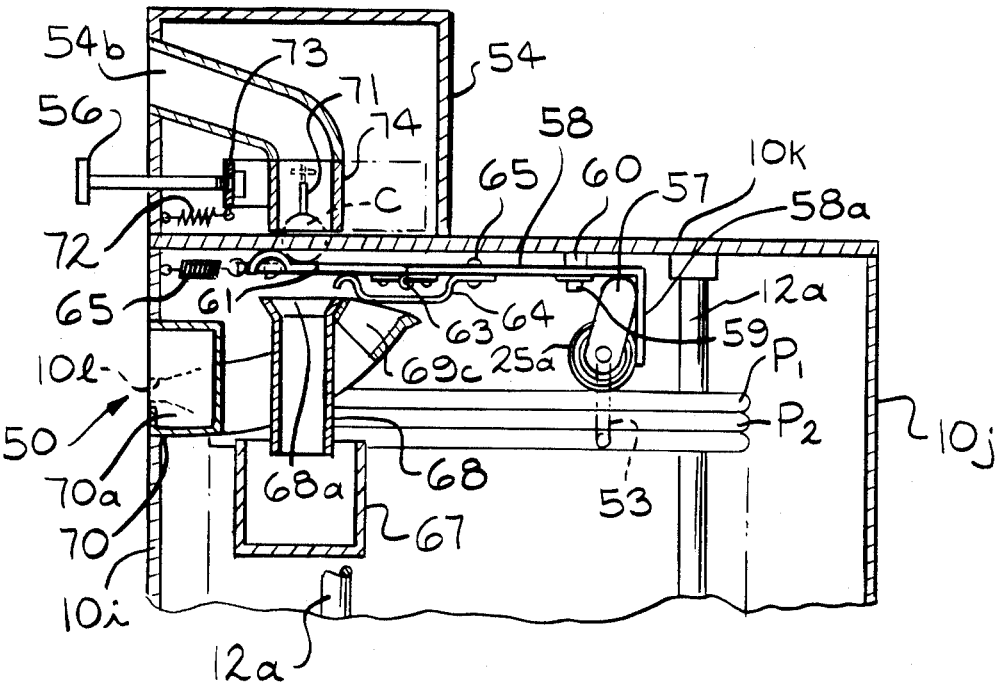
FIG. 9 shows a side view of the dispenser apparatus 50 along line 9—9 of FIG. 8.

FIGS. 8 and 9 show another preferred embodiment of the apparatus 50 of the prsent invention. The common elements with the apparatus 10 have letters beside the same numbers. The support plate 18*c* is mounted on posts 12*a* for sliding movement on bushings 18*e* and is biased by the same spring 15 shown in FIGS. 1 to 7. The slippery surface 18*d* is provided. The side walls 10*g* and 10*h*, the front and rear walls 10*i* and 10*j* and the top wall 10*k* enclose the dispensing apparatus 50.

Shaft 51 is horizontally mounted in bearings 52 and extends outside of the side wall 109. A crank handle 53 is mounted on shaft 51 so that the shaft 51 can be turned. Roller 23*a* is rotatably mounted on shaft 51 and is provided with rubber rings 25*a* which engage the uppermost newspaper $P_1$. Shaft 51 supports a rachet or pawl mechanism 36*a* which operates as shown in FIGS. 5 to 7.

Figure 10:
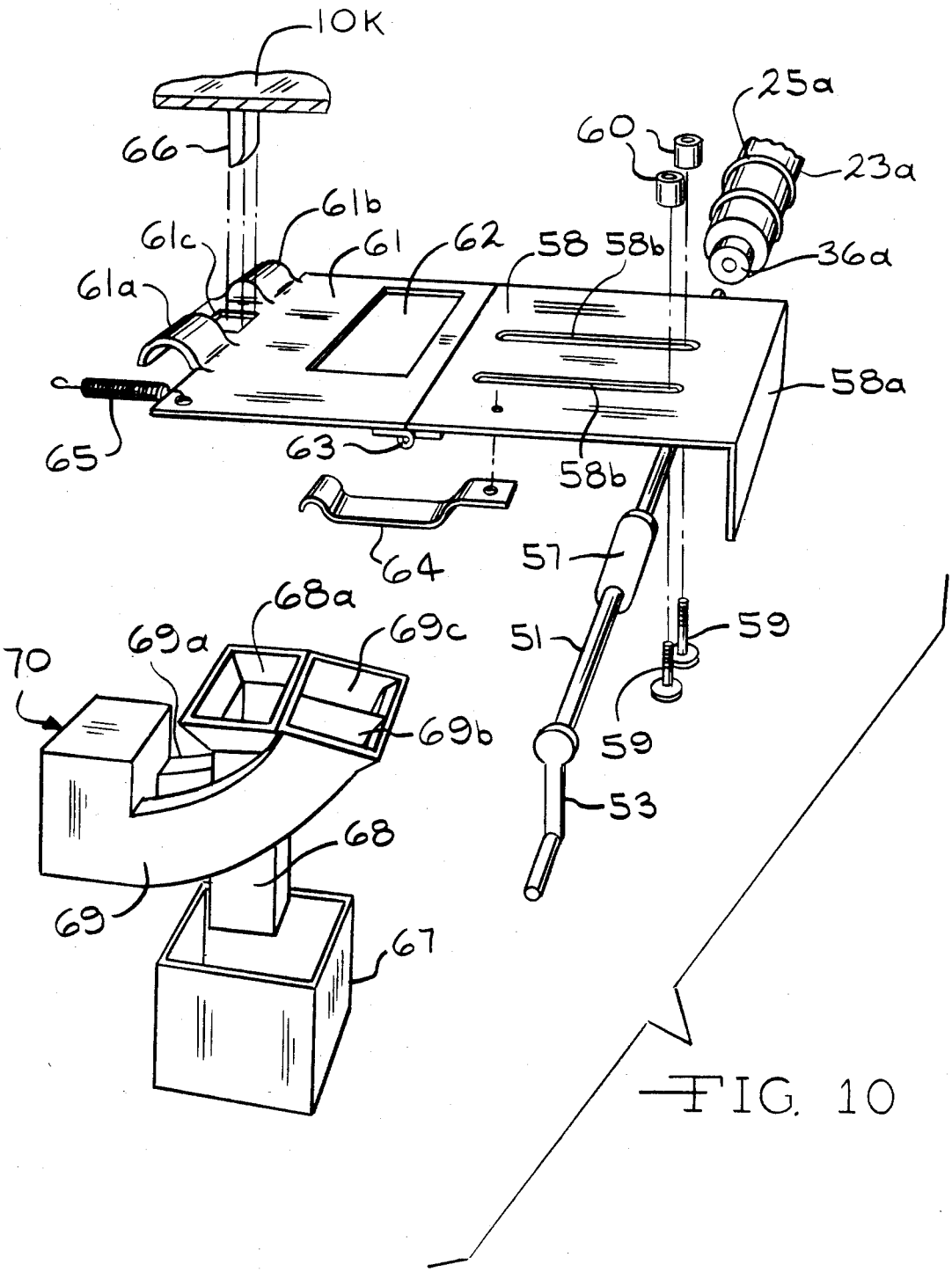
FIG. 10 is an exploded view of the preferred coin C operating mechanism.

FIGS. 8, 9 and 10 show a coin mechanism for use in the dispenser apparatus 50. A coin box 54 with coin slots 54*a* and 54*b* is mounted on the top wall 10*k*. The box 54 has a coin return push rod 56. The box 54 is provided with a coin C operated camming mechanism for allowing the handle 53 to rotate to dispense the newspaper $P_1$.

A cam arm 57 is fixed in position on shaft 51. The arm 57 engages a vertically oriented extension 58*a* of an adaptor plate 58 which is slideably mounted for horizontal movement on the top side 10*k* by means of bolts 59 and nuts 60. The adaptor plate 58 is provided with a moveable extension 61 with a coin return opening 62 and secured by a hinge 63 to adaptor plate 58. A retainer flat spring 64 is secured to plate 58 which returns the extension to the horizontal position. The flat spring 64 is held in place by bolt and nut 65. The extension 61 includes cam surfaces 61*a* and 61*b* at least one of which is engaged by the coin C. A coil spring 65 attached to the front wall 10*i* serves to return the adaptor plate 58 to a rest position as shown in FIG. 9 after the article $P_1$ has been dispensed. A pin 66 projects from the top wall 10*k* to engage an opening 61*c* in extension 61.

A coin box 67 is provided below a chute 68 leading to the box 67 from openings 68*a* and 68*b*. The box 67 receives the coins C which are retained in the apparatus 50 upon withdrawal of a newspaper $P_1$. Coin return chutes 69 and 69*a* lead from openings 69*b* and 69*c* to coin return outlet 70*a* in return box 70. The coin C is held in place adjacent cam surfaces 61*a* and 61*b* by means of pin 71 which allows the coin C to be positioned adjacent the cam surfaces 61*a* and 61*b* without allowing the coin C to move up the chute 54*a* or 54*b*. A spring 72 returns the rod 56 to the rest position. When the rod 56 is pushed the coin C is moved to opening 62 out through openings 69*b* and 69*c* of chute 69 to return box 70. The coin mechanism is conventional in the use of the coin C to act on the cam surfaces 61*a* and 61*b* and is sometimes referred to as a "K Mechanism".

The coin mechanism operates by inserting a coin(s) into slot 54*a* and/or 54*b*. The coin drops down onto and rests on extension 61. When the handle 53 is turned, shaft 51 and arm 57 pushes vertical extension 58*a* of plate 58 towards the rear wall 10*j*. The coin C cams over cam surface 61*a* and/or 61*b* and faces into opening 68*a* or 68*b* through chute 68 to box 67. The extension is pushed downward by coin C on hinge 63. The plate 58 slides horizontally in slots 58*b*. If a coin C is to be returned, the rod 56 is pushed to dislodge the coin C by means of pusher 73 which moves box 74 as shown by the dotted lines in FIG. 9.

In operation of the apparatus 50 a coin is inserted in slot 54*a* and/or 54*b* which allows the handle 53 to turn. The crank handle 53 is then turned clockwise to dispense newspaper $P_1$ out of opening 101. The user pulls the newspaper from the opening 101 and the plate 15*c* moves the next adjacent newspaper $P_2$ into engagement with rubber rings 25*a* on roller 23*a*. The rachet or pawl mechanism 36*a* allows the roller 23*a* to move with shaft 51 when the handle 53 is moved clockwise (FIG. 9) and allows the roller 23*a* to rotate on the shaft 51 when the handle is turned counterclockwise.

FIGS. 11 and 12 show modified versions of the apparatus shown in FIGS. 1 to 9. The dispenser apparatus 79 of FIG. 11 is the same as that shown in FIG. 1 except that the spring 15 is confined in a hollow post 80 with a solid support 81 engaging the lower spring retainer 16. The hollow post 80 includes a circular cross-section base 82. Chain 32*a* attaches to eye bolt 35*a* by means of hook 34*a*. Posts 12*a* are short and are supported on lower wall 10*m* attached to hollow post 80. The dispenser apparatus 90 of FIG. 12 is identical to that of FIG. 1 except that four (4) springs 15*a* are used to bias the support plate 18 upward.

Figure 1:
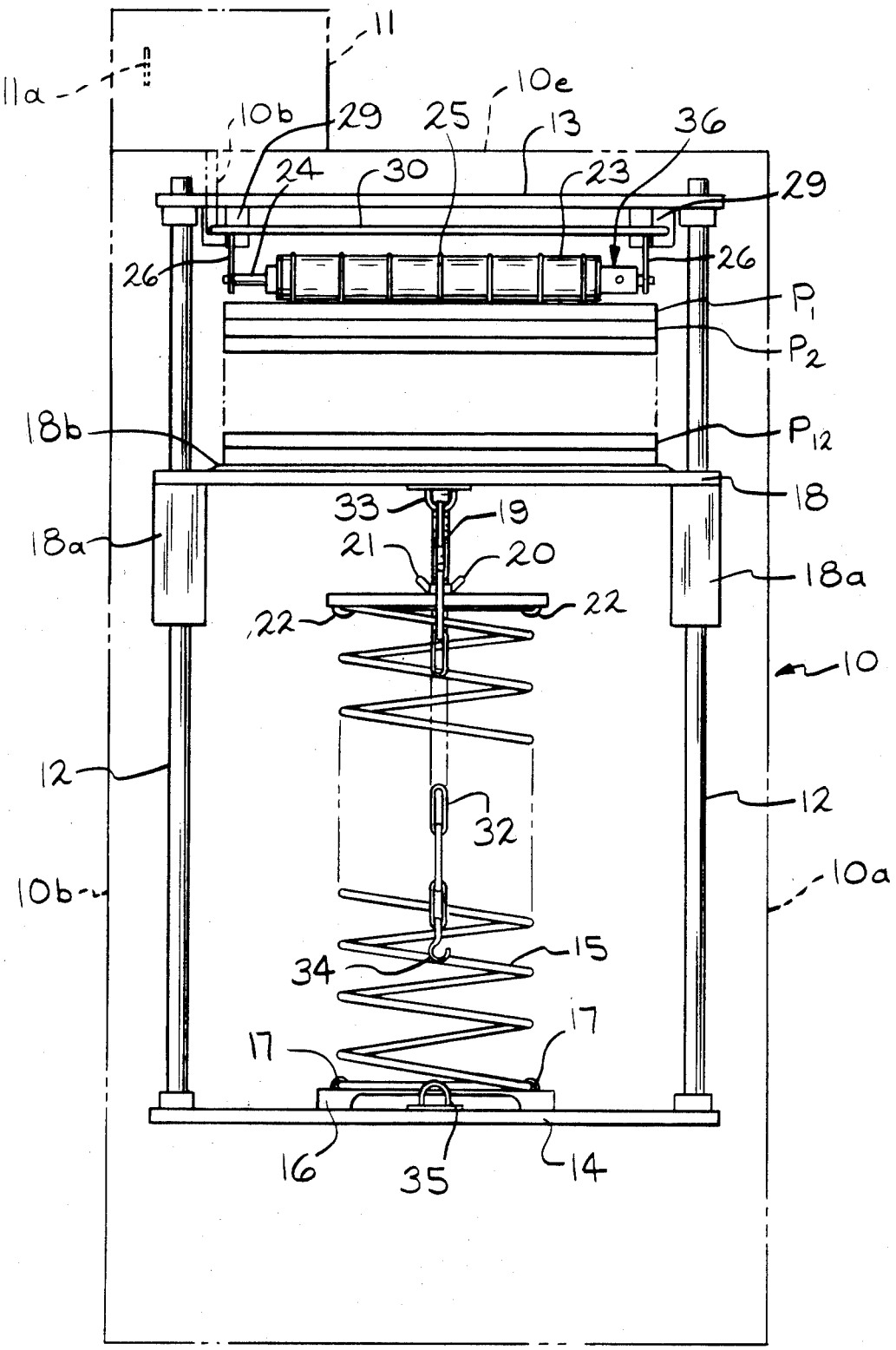
Figure 2:
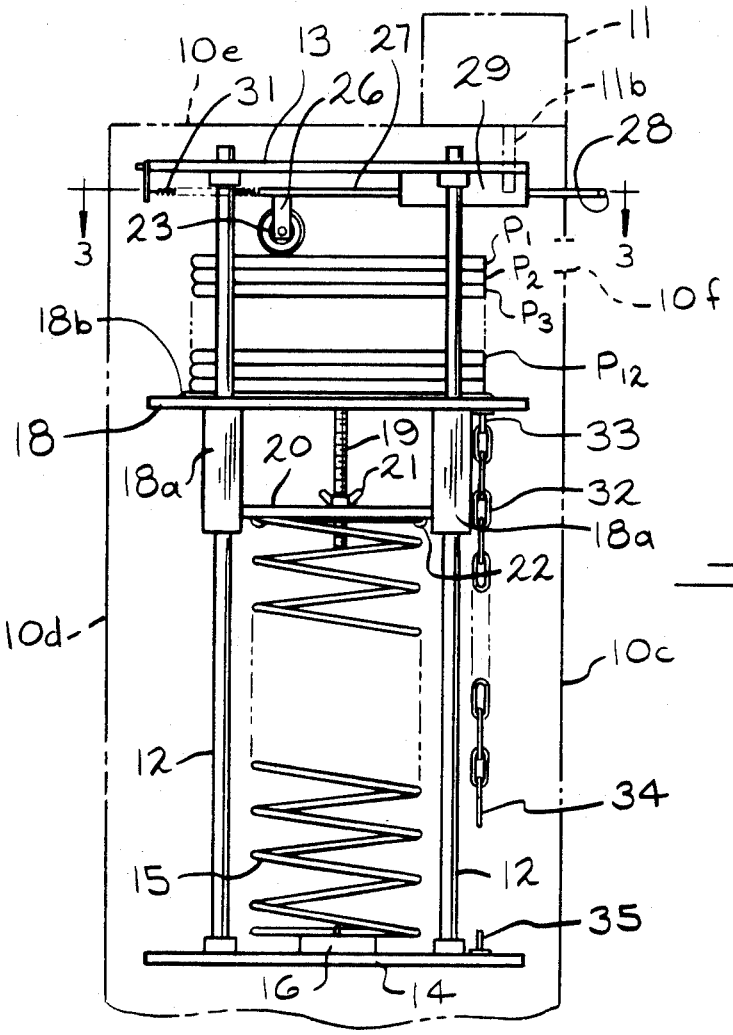
Figure 3:
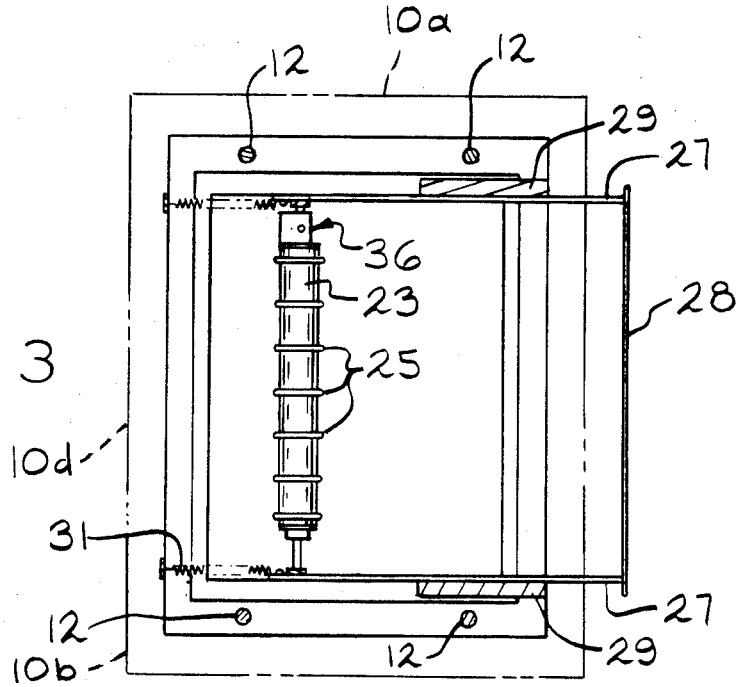
Figure 4:
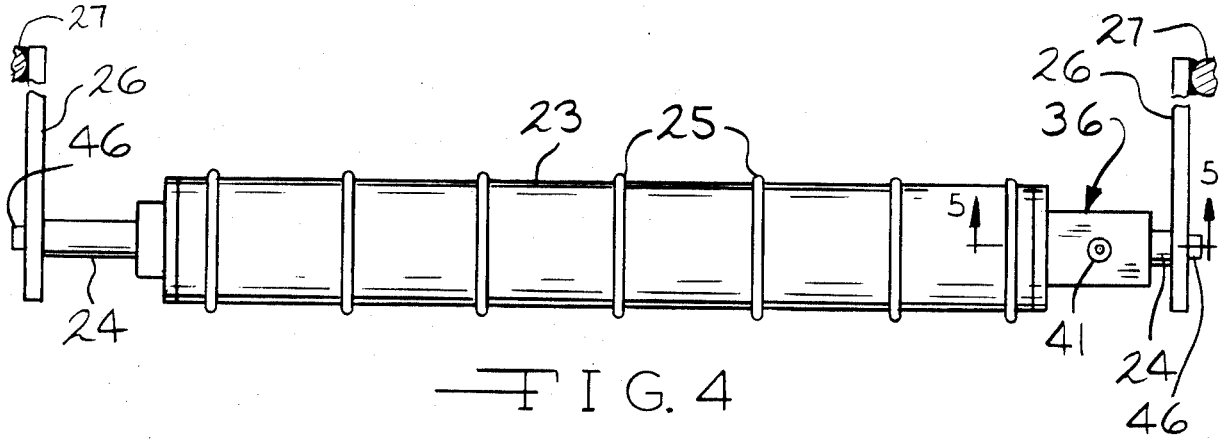

The apparatus of FIG. 11 operates in the same manner as in FIG. 1. It is convenient to use the hollow post 80 on base 82 in some locations. The apparatus of FIG. 12 uses the posts 12 to guide the springs 15*a*.

As can be seen from the foregoing description there are numerous apparatus where the roller 23 or 23*a* and rachet or pawl mechanisms 36 or 36*a* can be used to dispense elongate flat articles such as newspapers, magazines, books and packaged articles of all sorts. Numerous variations will occur to those skilled in the art and are intended to be included within the scope of the present invention.

I claim:

1. A dispensing apparatus for a pile of identical elongate flat articles having horizontally oriented sides and front and rear edges between the sides which comprises:

(a) a housing with spaced apart side walls with an opening on a front wall for dispensing the articles one at a time such that the front edge of the article projects out of the opening for manual removal;

(b) support plate means horizontally mounted in the housing below the opening for supporting the pile of articles with the front edges towards the front end of the housing wherein the support plate means is vertically moveable in the housing;

(c) resilient means for urging the support plate means vertically so as to align articles with the opening in the housing for dispensing;

(d) ejector means including a circular cross-sectioned roll means having opposing ends rotationally mounted on a shaft inside the housing above the support plate including spaced apart rings of an elastic material mounted on the roll means so that the rings on the roll means are continuously in contact with an uppermost article on the pile of articles for dispensing the uppermost article, wherein the shaft is journaled for rotation on a longitudinal axis between the opposed ends of the roller means;

(e) rachet means mounted on the shaft on at least one of the ends of the roll means such that the end of the roll means is engaged by the rachet means and such that the roll means rotates on the shaft in only one direction when the roll means is rotated away from the opening and prevents rotation of the roll on the shaft when the roll means is rotated towards the opening;

(f) handle means mounted on the shaft which can move the shaft and roll means together with the rachet means preventing rotation of the roll means on the shaft so as to dispense the article; and (g) a coin box mounted in the housing containing a coin mechanism which moves a coin over a cam surface on a moveable extension from an adapter plate to move the extension relative to the adapter plate and release a pin engaging the extension plate and wherein the ejector means rotates the shaft to turn an arm mounted on the shaft which moves the adapter plate and the extension to move the coin over the cam surface and drop the coin into a coin box and wherein the ejector means dispenses the article.

2. The apparatus of claim 1 wherein the handle means is a crank mounted on one of the side walls of the housing which rotates the shaft and wherein the shaft means is fixed in position in the housing intermediate the front and rear edges and between the sides of the article.

3. A dispensing apparatus for a pile of identical elongate flat articles having horizontally oriented sides and front edges between the sides which comprise:

(a) a housing with spaced apart side walls with an opening on a front wall for dispensing the articles one at a time such that the front edge of the article projects out of the opening for manual removal;

(b) support plate means horizontally mounted in the housing below the opening for supporting a pile of articles with the front edges towards the front end of the housing, wherein the support plate means is vertically moveable in the housing;

(c) resilient means for urging the support plate means vertically so as to align the articles with the opening in the housing for dispensing;

(d) ejector means including a circular cross-sectioned roll means having opposing ends rotationally mounted on a shaft inside the housing above the support plate including spaced apart rings of an elastic material mounted on the roll means so that the rings on the roll means are continuously in contact with an uppermost article on the pile of articles for dispensing the uppermost article, wherein the shaft is journaled for rotation by bearings mounted on the housing on a longitudinal axis of the shaft and between the opposed ends of the roller means;

(e) rachet means mounted on the shaft on at least one of the ends of the roll means such that the roll means is engaged by the rachet means such that the roll means rotates on the shaft in only one direction when the roll means is rotated away from the opening and prevents rotation of the roll on the shaft when the roll means is rotated towards the opening;

(f) crank handle means mounted on the shaft which can rotate the shaft and roll means together with the rachet means preventing rotation of the roll means on the shaft so as to dispense the article; and (g) a coin box supported on the housing containing a coin mechanism which moves a coin over a cam surface on a moveable extension from an adaptor plate to move the extension relative to the adaptor plate and release a pin engaging the extension plate and wherein the crank handle means rotates the shaft to turn an arm mounted on the shaft which moves the adaptor plate and the extension to move the coin over the cam surface and drop the coin in a coin box and wherein rotation of the crank handle dispenses the article.

4. The apparatus of claim 3 wherein the roll means is a circular cross-sectional tube which has grooves around the axis on the outer surface and wherein the rings of elastic material are mounted in the grooves so as to contact the uppermost article to be dispensed.

5. The apparatus of claim 4 wherein the tube is plastic and mounted on the shaft and wherein one end of the shaft supports the rachet means which engages the indentations in one end of the roll means.

6. The apparatus of claim 3 wherein the resilient means is a corrosion resistant steel coil spring.

7. The apparatus of claim 3 wherein the support plate is journaled on posts by self-lubricating plastic bearings.

8. The apparatus of claim 3 wherein the adaptor plate and extension is mounted inside and adjacent to a top wall of the housing covering the side walls and wherein the plate and extension slides horizontally towards the rear wall upon engagement of a vertically oriented extension of the adaptor plate by the arm on the shaft turned by the crank handle.

9. A dispensing apparatus for a pile of identical elongate flat articles having horizontally oriented sides and front and rear edges between the sides which comprises:

(a) a housing with spaced apart side walls with an opening on a front wall for dispensing the articles one at a time such that the front edge of the article projects out of the opening for manual removal;

(b) support plate means horizontally mounted in the housing below the opening for supporting the pile of articles with the front edges towards the front end of the housing wherein the support plate means is vertically moveable in the housing;

(c) resilient means for urging the support plate means vertically so as to align articles with the opening in the housing for dispensing;

(d) ejector means including roll means having opposing ends rotationally mounted on a shaft inside the housing above the support plate so that an outer surface of the roll means is continuously in contact with an uppermost article on the pile of articles for dispensing the uppermost article, wherein the shaft is journaled for rotation on a longitudinal axis between the opposed ends of the roller means and wherein the roll means has grooves spaced along the axis on the outer surface;

(e) rings of an elastic material mounted in the grooves so as to contact the uppermost article as it is being dispensed;

(f) roll holding means mounted on the shaft such that the roll means rotates on the shaft in only one direction when the roll means is rotated away from the opening and prevents rotation of the roll on the shaft when the roll means is rotated towards the opening; and (g) handle means mounted on the shaft which can move the shaft and roll means together with the rachet means preventing rotation of the roll means on the shaft so as to dispense the article.

10. The apparatus of claim 9 wherein the holding means is a rachet means.

* * * * *